US005575480A

United States Patent [19]

Wehr

[11] Patent Number: 5,575,480

[45] Date of Patent: Nov. 19, 1996

[54] TOSS GAME APPARATUS

[76] Inventor: Craig M. Wehr, 5601 Calvine Rd., Sacramento, Calif. 95823

[21] Appl. No.: 615,711

[22] Filed: Mar. 13, 1996

[51] Int. Cl.[6] ..... A63B 67/06

[52] U.S. Cl. ..... 273/402

[58] Field of Search ..... 273/400, 401, 273/402

[56] References Cited

U.S. PATENT DOCUMENTS

| | | | |
|---|---|---|---|
| 163,845 | 6/1875 | Browne | 273/402 |
| 3,815,915 | 6/1974 | Chapman | 273/338 |
| 3,964,745 | 6/1976 | Ogg | 273/401 |
| 4,012,042 | 3/1977 | Blasingame | 273/401 |
| 4,203,592 | 5/1980 | Quatkemeyer | 273/336 |
| 4,243,229 | 1/1981 | Huser et al. | 273/402 |
| 4,927,161 | 5/1990 | Brenneman | 273/402 |
| 4,936,590 | 6/1990 | Palmer | 273/402 |
| 4,974,858 | 12/1990 | Knowlton | 273/401 |
| 5,056,797 | 10/1991 | Hockert et al. | 273/402 |

*Primary Examiner*—William H. Greib
*Attorney, Agent, or Firm*—Thomas R. Lampe

[57] ABSTRACT

Toss game apparatus for alternate use as a target for thrown projectiles or as a support for supporting an individual playing the toss game includes a frame and a top panel mounted on the frame and deflectable relative to the frame. Interior support members attached to the top panel limit the degree of deflection of the top panel. Carpeting is positioned on the top panel having an upper layer of upwardly projecting fabric fibers angled toward one of the frame ends.

8 Claims, 2 Drawing Sheets

TOSS GAME APPARATUS

TECHNICAL FIELD

This invention relates to toss game apparatus, and more particularly to apparatus alternately employed as a target for thrown objects or projectiles and as a support for supporting an individual playing the toss game.

BACKGROUND ART

Toss or pitch games are well known in the toy and recreation arts. Some of these games utilize platforms which define openings into which the player attempts to toss, pitch or lob discs, rings or similar objects. The platform sometimes also serves as a support for a player throwing projectiles toward a platform of like construction spaced a distance away.

U.S. Pat. No. 4,927,161, issued May 22, 1990, for example, discloses a projectile throwing game which employs at least two target tray structures or platforms and a plurality of projectiles. The game consists of two platforms with three circular holes in each platform. The platforms are joined together with a chain or other linkage to maintain a fixed distance therebetween. A player stands on top of the platform at the end where the linkage is fastened and tosses, pitches or lobs a disc toward the other platform trying to hit one of the holes. Each hole is worth a particular number of points.

Each target structure of the chip shot game of U.S. Pat. No. 4,927,161 comprises a target board formed of wood, plastic or metal having a substantially rectangular configuration with opposite side edges supportingly connected to a pair of spaced apart side supports and its opposite side ends supported by end supports. Interior supports are employed to provide additional support for the target board and to provide a more rugged structure sufficiently strong to support the weight of players.

It will be appreciated that such an arrangement is of very rigid construction with the top panel or target board being extremely rigid and not being capable of deflection when impacted by an object. It is preferable to employ a "live" board having some deflection or give when impacted by a thrown object to absorb energy and reduce object bounce. Furthermore, the upper smooth face of the top board can be scuffed of damaged during use as well as operate as a deterrent to the retention of projectiles on the board, the latter perhaps being desirable, particularly when game scoring includes a score for a tossed object remaining positioned on the board and not in the holes. Also, the smooth nature of the board top surface can allow an object to slide into a hole even if the throw was not accurate. In other words, the target structure of the chip shot game disclosed in U.S. Pat. No. 4,927,161 does not readily lend itself to certain types of games due to the rigid top board structure and smooth upper surface.

U.S. Pat. No. 4,936,590, issued Jun. 26, 1990, discloses a portable pitch game which also employs two multi-apertured rectangular platforms. Here also, the apertured top panels are located over partition-like supports and rigidly supported thereby. U.S. Pat. No. 4,936,590 suggests the concept of texturing the standing areas of the platforms to prevent slipping by the players but this embellishment does not overcome the difficulties recited with respect to the similar arrangement disclosed in U.S. Pat. No. 4,927,161, noted in detail above.

The following patents are also believed to be representative of the present state of the prior art in this field: U.S. Pat. No. 163,845, issued Jun. 1, 1875, U.S. Pat. No. 4,243,229, issued Jan. 6, 1981, U.S. Pat. No. 4,974,858, issued Dec. 4, 1990, U.S. Pat. No. 4,203,592, issued May 20, 1980, U.S. Pat. No. 3,815,915, issued Jun. 11, 1974, and U.S. Pat. No. 5,056,797, issued Oct. 15, 1991.

DISCLOSURE OF INVENTION

The toss game apparatus of the present invention incorporates unique structure which enhances the gaming characteristics of the apparatus. The apparatus includes a top panel which is deflectable to some extent and cooperable with other structural elements of the apparatus to allow deflection of the top panel during play to absorb energy of projectiles while still serving as a proper and adequate support for an individual standing on the top panel when throwing projectiles to apparatus of like construction. Furthermore, the top panel of the apparatus is covered by carpeting of a specific character to both protect the top panel and encourage retention of tossed projectiles thereon.

The toss game apparatus of the present invention is for alternate use as a target for thrown projectiles or as a support for supporting an individual playing the toss game. The apparatus includes a frame positionable on a surface, the frame being of substantially rectangular configuration, including a pair of spaced, elongated frame side walls and a pair of spaced frame end walls affixed to the frame side walls, and defining a frame interior of substantially rectangular configuration.

A top panel is connected to the frame and covers the frame interior. The top panel defines a plurality of openings spaced from each other and communicating with the frame interior.

At least one interior support member is connected to the top panel. The support member extends downwardly from the top panel into the frame interior between the frame side walls and between the frame end walls and terminates adjacent to the surface. The support member has opposed sides adjacent to the frame side walls and movable relative to the frame side walls upon deflection of the top panel relative to the frame.

The apparatus additionally includes a layer of carpeting over the top panel, the carpeting having an upper layer comprised of upwardly projecting fabric fibers angled toward one of the frame walls and away from an opposed framed end wall.

Other features, advantages, and objects of the present invention will become apparent with reference to the following description and accompanying drawings.

BEST MODE FOR CARRYING OUT THE INVENTION

Figure 1:
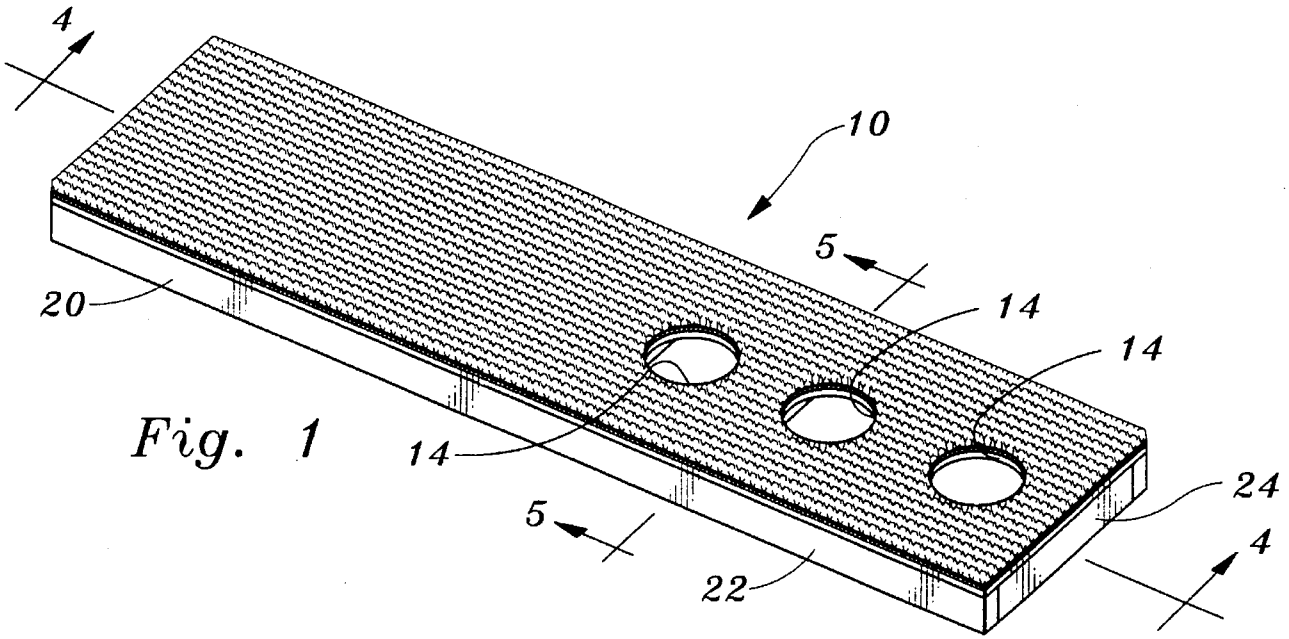
FIG. 1 is a perspective view of toss game apparatus constructed in accordance with the teachings of the present invention.
Figure 2:
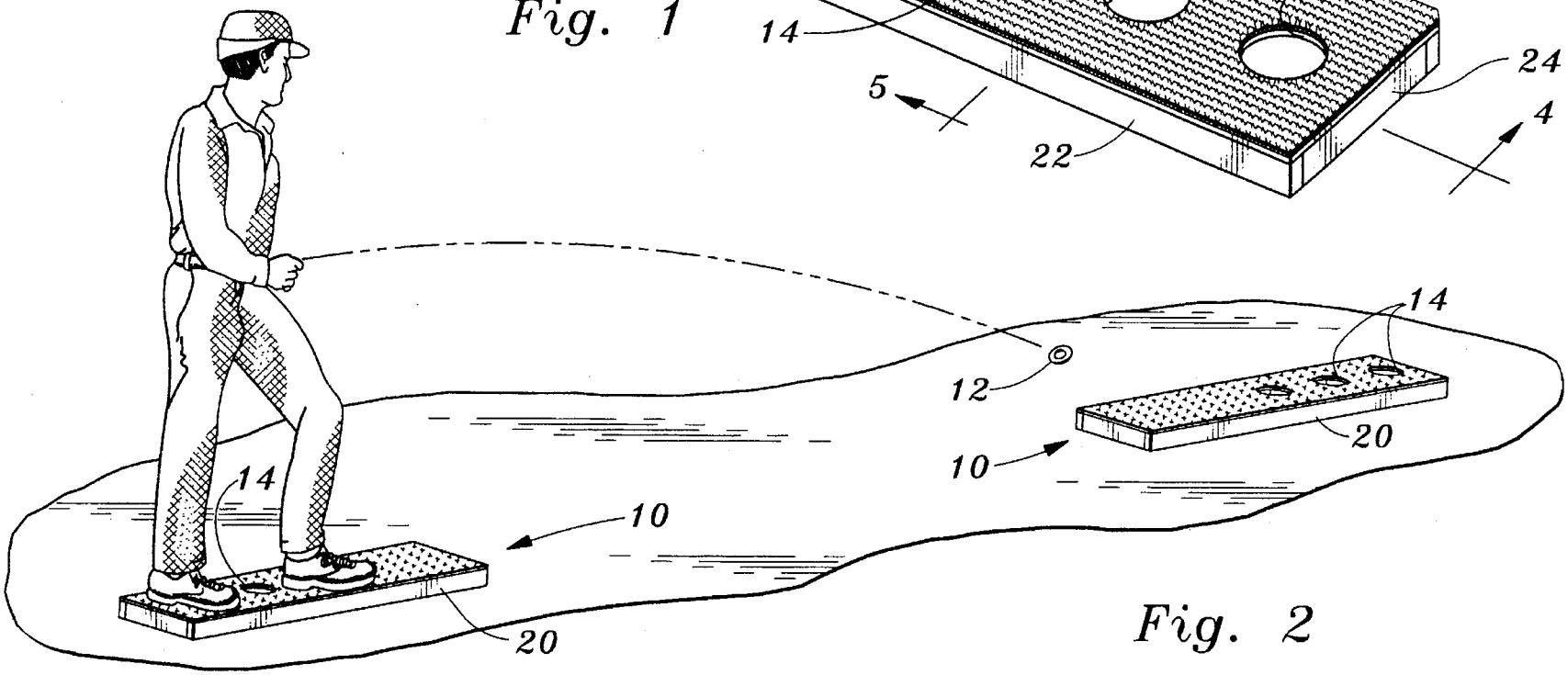
FIG. 2 is a perspective view of an individual standing on the toss game apparatus of FIG. 1 and throwing an object or projectile toward toss game apparatus of like construction located a distance away.
Figure 3:
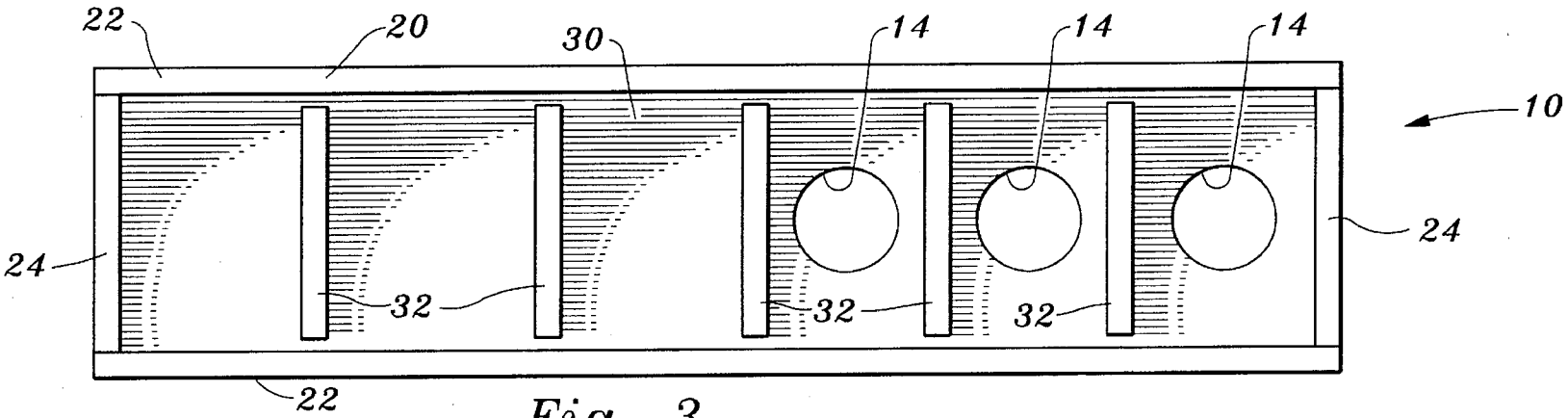
FIG. 3 is a bottom view of the toss game apparatus.
Figure 4:
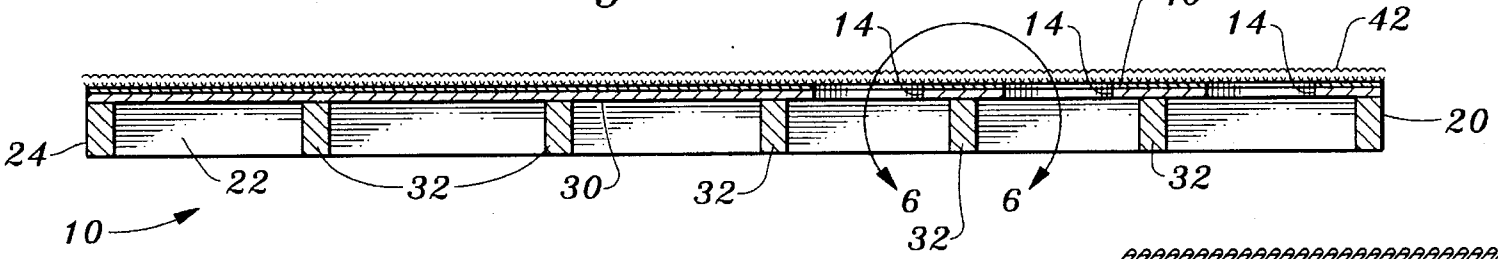
FIG. 4 is a cross-sectional view taken along the line 4—4 in FIG. 1.
Figure 6:
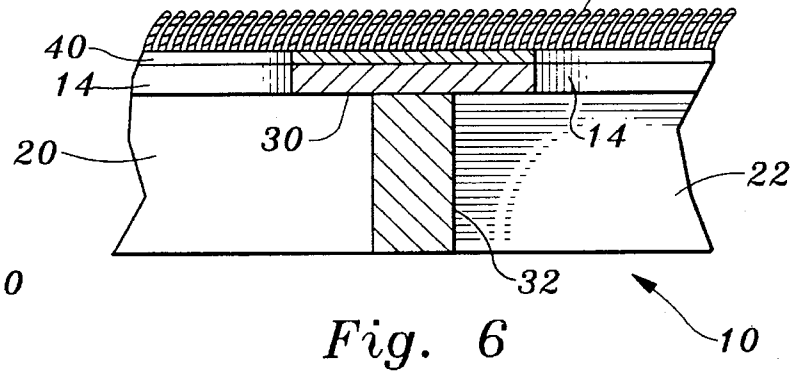
FIG. 6 is an enlarged sectional view illustrating a segment of the toss game apparatus as delineated by the double headed arrow 6—6.

Referring now to FIGS. 1–6, apparatus constructed in accordance with the teachings of the present invention is generally designated by reference numeral 10. Normally, two units of apparatus 10 of identical construction are employed and deployed as shown in FIG. 2, the units being spaced from one another a determined distance. One of the apparatus units serves as a target for thrown projectiles while the other supports an individual playing the toss game. The object is to throw a projectile 12 of any desired character into one of the openings 14 in the apparatus, the score usually being determined by which opening receives the projectile. Various types of games may also provide a score for projectiles remaining on the apparatus but not falling into the holes.

Apparatus 10 includes a frame 20 positionable on the ground or other surface. Frame 20 is of substantially rectangular configuration, including a pair of spaced, elongated frame side walls 22 and a pair of spaced frame end walls 24 affixed to the frame side walls. The walls may be constructed of any suitable material such as wood and may be secured to each other in any desired fashion such as by mechanical fasteners or glue. Frame 20 defines a frame interior of substantially rectangular configuration.

A top panel 30 is connected to the frame 20 and covers the frame interior. The top panel defines the plurality of openings 14, which are spaced from one another and communicate with the frame interior. In the arrangement of FIG. 1 through 6, the panel 30 has an outer margin located above both frame side walls and both frame end walls.

Affixed to the underside of top panel 30 and extending downwardly therefrom into the frame interior between the frame side walls and between the frame end walls are a plurality of support members 32 in the form of boards which are secured to the top panel by any desired expedient such as mechanical fasteners of glue. In the arrangement illustrated, the support members 32 are affixed to the top panel at spaced locations between the openings 14.

The ends of the support members 32 are spaced inwardly from frame side walls 20, 22. This will create a top panel which is "live" and free to move somewhat when impacted by a projectile, absorbing energy and enhancing playability of the apparatus,, On the other hand, the interior support member 32 will prevent the top panel 30 from flexing to an extreme degree when a player stands on the apparatus.

The apparatus also includes a layer of carpeting 40 applied over the top panel, it being understood that the carpeting has holes corresponding to the openings 14 in the top panel.

The carpeting also enhances playability of a toss game in that it is of particular construction which will cooperate with a tossed projectile to somewhat limit sliding of the tossed projectile on the top board when it impacts the top board so that movement of the projectile off the panel or board is less likely. This action is enhanced by the fact that the carpeting 40 has an upper layer 42 comprised of upwardly projecting fabric fibers angled toward one of the frame end walls and away from the other of the frame end walls. During play, the apparatus will be oriented with the fabric fibers angled toward the other apparatus employed during the game.

Although three openings 14 are shown in the embodiment just described, this is for illustrative purposes only, and it will be appreciated that lesser or greater numbers of openings can be employed without departing from the scope of the invention.

Figure 5:
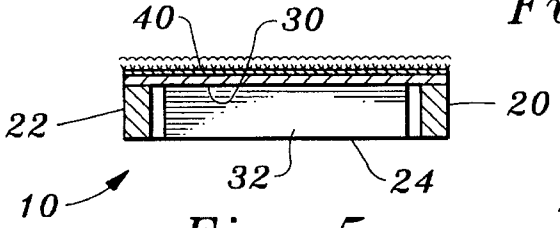
FIG. 5 is a cross-sectional view taken along the line 5—5 in FIG. 1.
Figure 7:
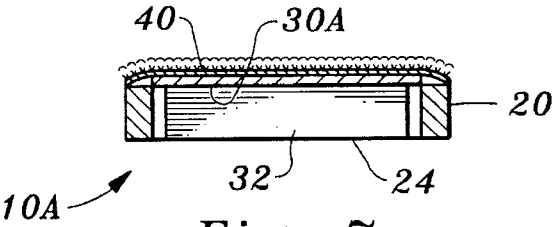
FIG. 7 is a view similar to FIG. 5 but illustrating an alternate form of the invention.

FIG. 7 is a view similar to FIG. 5 but illustrating an alternative form of the apparatus, apparatus 10A, which employs a top panel 30A having its side edges spaced inwardly of the frame side walls. This arrangement will permit more dynamic movement of the top panel when impacted by a projectile than does top panel 30 of the first embodiment described above.

I claim:

1. Toss game apparatus for alternate use as a target for thrown projectiles or as a support for supporting an individual playing the toss game, said apparatus comprising, in combination:

a frame positionable on a surface, said frame being of substantially rectangular configuration, including a pair of spaced, elongated frame side walls and a pair of spaced frame end walls affixed to said frame Side walls, and defining a frame interior of substantially rectangular configuration;

a top panel connected to said frame and covering said frame interior, said top panel defining at least one opening communicating with said frame interior; and at least one interior support member connected to said top panel, extending downwardly from said top panel into said frame interior between said frame Side walls and between said frame end walls and terminating adjacent to said surface, said support member having opposed sides adjacent to said frame side walls and movable relative to said frame side walls upon deflection of said top panel relative to said frame.

2. The toss game apparatus according to claim 1 wherein a plurality of interior support members are connected to said top panel at spaced locations on said top panel, said interior support members being spaced from one another.

3. The toss game apparatus according to claim 2 wherein said interior support members comprise a plurality of generally rectangular boards Secured to said top panel at said spaced locations.

4. The toss game apparatus according to claim 1 additionally including carpeting over said top panel, said carpeting having an upper layer comprised of upwardly projecting fabric fibers angled toward one of the frame walls and away from an opposed frame wall.

5. The toss game apparatus according to claim 2 wherein said interior support members have lower distal ends above said surface.

6. The toss game apparatus according to claim 1 wherein said top panel has side edges spaced inwardly of said frame side walls.

7. The toss game apparatus according to claim 1 wherein said top panel has an outer margin located above said frame side walls and frame end walls.

8. Toss game apparatus for alternate use as a target for thrown projectiles or as a support for supporting an individual playing the toss game, said apparatus comprising, in combination:

a frame positionable on a surface, said frame being of substantially rectangular configuration, including a pair of spaced, elongated frame side Walls and a pair of spaced frame end walls affixed to said frame side walls, and defining a frame interior of substantially rectangular configuration;

a top panel connected to said frame and covering said frame interior, said top panel defining at least one opening communicating with said frame interior;

at least one interior support member connected to said top panel, extending downwardly from said top panel into said frame interior between said frame side walls and between said frame end walls and terminating adjacent to said surface, said support member having opposed sides adjacent to and spaced from said frame side walls; and carpeting over said top panel, said carpeting having an upper layer comprised of upwardly projecting fabric fibers angled toward one of the frame walls and away from an opposed frame wall.

* * * * *